US008494428B2

(12) United States Patent
Azeyanagi et al.

(10) Patent No.: US 8,494,428 B2
(45) Date of Patent: Jul. 23, 2013

(54) LUBRICANT APPLICATOR, PROCESS UNIT INCLUDING THE LUBRICANT APPLICATOR, TRANSFER UNIT INCLUDING THE LUBRICANT APPLICATOR, AND IMAGE FORMING APPARATUS INCLUDING THE PROCESS UNIT OR THE TRANSFER UNIT

(75) Inventors: Yuta Azeyanagi, Kanagawa (JP); Ken Amemiya, Tokyo (JP); Satoshi Hatori, Kanagawa (JP); Toshio Koike, Tokyo (JP); Yuji Arai, Kanagawa (JP); Michiya Okamoto, Kanagawa (JP); Takuma Iwasaki, Kanagawa (JP); Akira Fujimori, Kanagawa (JP); Kaoru Yoshino, Tokyo (JP); Takaaki Tawada, Kanagawa (JP); Takatsugu Fujishiro, Tokyo (JP)

(73) Assignee: Ricoh Company, Ltd, Tokyo (JP)

( * ) Notice: Subject to any disclaimer, the term of this patent is extended or adjusted under 35 U.S.C. 154(b) by 274 days.

(21) Appl. No.: 12/926,402

(22) Filed: Nov. 16, 2010

(65) Prior Publication Data

US 2011/0123239 A1 May 26, 2011

(30) Foreign Application Priority Data

Nov. 26, 2009 (JP) ..... 2009-268909
Oct. 28, 2010 (JP) ..... 2010-242269

(51) Int. Cl.
*G03G 21/00* (2006.01)

(52) U.S. Cl.
USPC ..... 399/346

(58) Field of Classification Search
USPC ..... 399/346, 343
See application file for complete search history.

(56) References Cited

U.S. PATENT DOCUMENTS

| | | | | |
|---|---|---|---|---|
| 4,912,516 | A * | 3/1990 | Kaieda | 399/312 |
| 7,149,465 | B2 | 12/2006 | Amemiya et al. | |
| 2005/0074264 | A1 | 4/2005 | Amemiya et al. | |
| 2005/0164108 | A1 | 7/2005 | Murakami et al. | |
| 2007/0071525 | A1 * | 3/2007 | Yoshino et al. | 399/346 |
| 2007/0209877 | A1 | 9/2007 | Arai et al. | |
| 2009/0010693 | A1 | 1/2009 | Hatori et al. | |
| 2009/0103944 | A1 | 4/2009 | Shintani et al. | |
| 2009/0185842 | A1 | 7/2009 | Hatori et al. | |
| 2009/0241830 | A1 | 10/2009 | Koike et al. | |
| 2009/0252510 | A1 | 10/2009 | Shintani et al. | |
| 2010/0183349 | A1 | 7/2010 | Shintani et al. | |

FOREIGN PATENT DOCUMENTS

| | | |
|---|---|---|
| JP | 06-056539 | 3/1994 |
| JP | 2007-140377 | 6/2007 |

* cited by examiner

*Primary Examiner* — G. M. Hyder
(74) *Attorney, Agent, or Firm* — Harness, Dickey & Pierce, P.L.C.

(57) ABSTRACT

A lubricant applicator includes a lubricant and a rotatable lubricant application member. The rotatable lubricant application member contacts the lubricant and an application target to apply the lubricant to the application target while rotating. The lubricant application member includes a core member, a first wound portion including a bristle member wound spirally around the periphery of the core member in a first direction, and a second wound portion including a bristle member wound spirally around the periphery of the core member in a second direction opposite the first direction in an axial direction of the core member. A process unit includes the lubricant applicator. A transfer device includes the lubricant applicator. An image forming apparatus includes at least one of the process unit and the transfer device and the lubricant applicator.

15 Claims, 9 Drawing Sheets

LUBRICANT APPLICATOR, PROCESS UNIT INCLUDING THE LUBRICANT APPLICATOR, TRANSFER UNIT INCLUDING THE LUBRICANT APPLICATOR, AND IMAGE FORMING APPARATUS INCLUDING THE PROCESS UNIT OR THE TRANSFER UNIT

CROSS-REFERENCE TO RELATED APPLICATIONS

This patent application is based on and claims priority pursuant to 35 U.S.C. §119 from Japanese Patent Application Nos. 2009-268909, filed on Nov. 26, 2009, and 2010-242269, filed on Oct. 28, 2010 both in the Japan Patent Office, which are hereby incorporated herein by reference in their entirety.

BACKGROUND OF THE INVENTION

1. Field of the Invention

Exemplary aspects of the present invention generally relate to a lubricant, a process unit including the lubricant, a transfer unit, and an image forming apparatus such as a copier, a printer, a facsimile machine, or a multi-functional system including a combination thereof, and more particularly, to a lubricant applicator that applies a lubricant 2. Description of the Background Art Typically, image forming apparatuses, such as copiers, printers, facsimile machines, and multi-functional systems including a combination thereof, form a toner image on a photoreceptor, and then the toner image is transferred onto an intermediate transfer member.

Various attempts have been made to improve cleanability, transferability, and durability of the photoreceptor and the intermediate transfer member in the image forming apparatuses. One example of such attempts includes application of a lubricant such as zinc stearate to the photoreceptor, intermediate transfer belt, and so forth using a lubricant applicator.

FIG. 14 is a schematic diagram illustrating one example of a related-art lubricant applicator that applies the lubricant to the surface of the photoreceptor. A lubricant applicator 100 in FIG. 14 includes a lubricant 200 in solid form, an application brush 300, a lubricant holder 400, a biasing member 500, and a guide member 600. The application brush 300 serves as a lubricant application member. The lubricant holder 400 holds the lubricant 200. The biasing member 500 urges the lubricant 200 against the application brush 300 so that the lubricant 200 contacts the application brush 300. The guide member 600 guides the lubricant 200 in both approaching and separating from the application brush 300.

The application brush 300 is disposed close enough to contact the surface of a photoreceptor 700. As the application brush 300 rotates, the application brush 300 scrapes off the lubricant 200 and applies the scraped lubricant onto the surface of the photoreceptor 700.

Since the lubricant 200 is pressed against the application brush 300 by the biasing member 500, the lubricant 200 remains in contact with the application brush 300 even after the lubricant 200 is scraped off and consumed.

Various types of application brushes for applying the lubricant have been proposed. For example, Japanese Examined Patent Application No. H06-56539 (JP-H06-56539-B) proposes an application brush including a rod or a cylindrical core on which a strip member implanted with fibers is wound spirally in one direction. However, as illustrated in FIG. 15, there is a drawback to this configuration in that, when the application brush 300 consisting of the core, on which the strip member implanted with fibers is wound spirally in one direction, is rotated, a moving force F is generated in one way in an axial direction of the application brush 300 relative to the lubricant 200.

Such a moving force F causes a portion of the lubricant 200 or the lubricant holder 400 to contact the guide member 600, creating resistance. As a result, the pressure of the biasing member 500 changes at both ends of the lubricant 200, varying the amount of lubricant scraped by the application brush 300 at both ends of the lubricant 200, and thus the lubricant 200 is applied irregularly to the photoreceptor 700 in the axial direction of the application brush 300.

Referring to FIG. 16, a description is provided of the irregular force applied to a contact portion of the lubricant 200 and the application brush 300 toward the application brush 300. FIG. 16 is a schematic diagram illustrating the irregular force. As illustrated in FIG. 16, the force f is applied irregularly along the axial direction.

Furthermore, the irregular pressure at both ends of the lubricant 200 causes consumption of the lubricant 200 to increase at the end portion thereof where the pressure is high. On the other hand, when the end portion of the lubricant 200 where the pressure is low, the lubricant 200 is not adequately scraped (consumed). As a result, as illustrated in FIG. 17, irregular abrasion of the lubricant 200 occurs, hindering effective use of the lubricant 200. FIG. 17 is a schematic diagram illustrating irregular abrasion of the lubricant 200.

Referring now to FIG. 18, there is provided a schematic diagram illustrating a state in which the lubricant 200 is not parallel but inclined relative to the application brush 300. As illustrated in FIG. 18, when one end portion of the lubricant 200 or the lubricant holder 400 contacts the guide member 600 and is stuck, the lubricant 200 is pressed against the application brush 300 in an inclined manner. In such a case, the amount scraped by the application brush 300 at both ends of the lubricant 200 varies, thereby causing a problem similar to that described above, such as irregular application and abrasion of the lubricant 200.

Referring now to FIGS. 19A and 19B, there are provided schematic diagrams illustrating a state in which the lubricant remains parallel to the application brush 300 but one end portion of the lubricant 200 is offset or separated from the application brush 300. As illustrated in FIG. 19A, when the lubricant 200 drifts axially in one way, causing one end portion thereof to separate from the application brush 300, the separated portion of the lubricant 200 is not consumed. As a result, irregular abrasion occurs in the lubricant 200 as illustrated in FIG. 19B.

In view of the foregoing, for example, Japanese Patent Unexamined Application Publication 2007-140377 (JP-2007-140377-A) proposes using a plurality of rotary arms, which enables the lubricant to contact and separate from the application brush while maintaining the lubricant parallel to the application brush. In this configuration, the lubricant is pressed against the application brush evenly, thereby applying the lubricant evenly to the photoreceptor axially of the application brush.

However, there is a drawback in this configuration in that, equipped with a plurality of rotary arms, the number of parts increases, thereby complicating its manufacture and increasing its cost.

In view of the above, there is demand for a device capable of preventing irregular consumption and irregular application of the lubricant with yet a simple, uncomplicated configuration.

SUMMARY OF THE INVENTION

In view of the foregoing, in one illustrative embodiment of the present invention, a lubricant applicator includes a lubricant and a rotatable lubricant application member. The rotatable lubricant application member contacts the lubricant and an application target to apply the lubricant to the application target while rotating. The lubricant application member includes a core member, a first wound portion including a bristle member wound spirally around the periphery of the core member in a first direction, and a second wound portion including a bristle member wound spirally around the periphery of the core member in a second direction opposite the first direction in an axial direction of the core member.

In another illustrative embodiment of the present invention, a process unit detachably attachable to an image forming apparatus includes an image bearing member to bear an image and the lubricant applicator.

In yet another illustrative embodiment of the present invention, a transfer device includes a transfer member onto which an image on an image bearing member is transferred, and the lubricant applicator.

In yet another illustrative embodiment of the present invention, an image forming apparatus includes the lubricant applicator, and at least one of a process unit removably installable in the image forming apparatus and having an image bearing member to bear an image and a transfer member onto which the image on the image bearing member is transferred.

In yet another illustrative embodiment of the present invention, an image forming apparatus includes the lubricant applicator.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
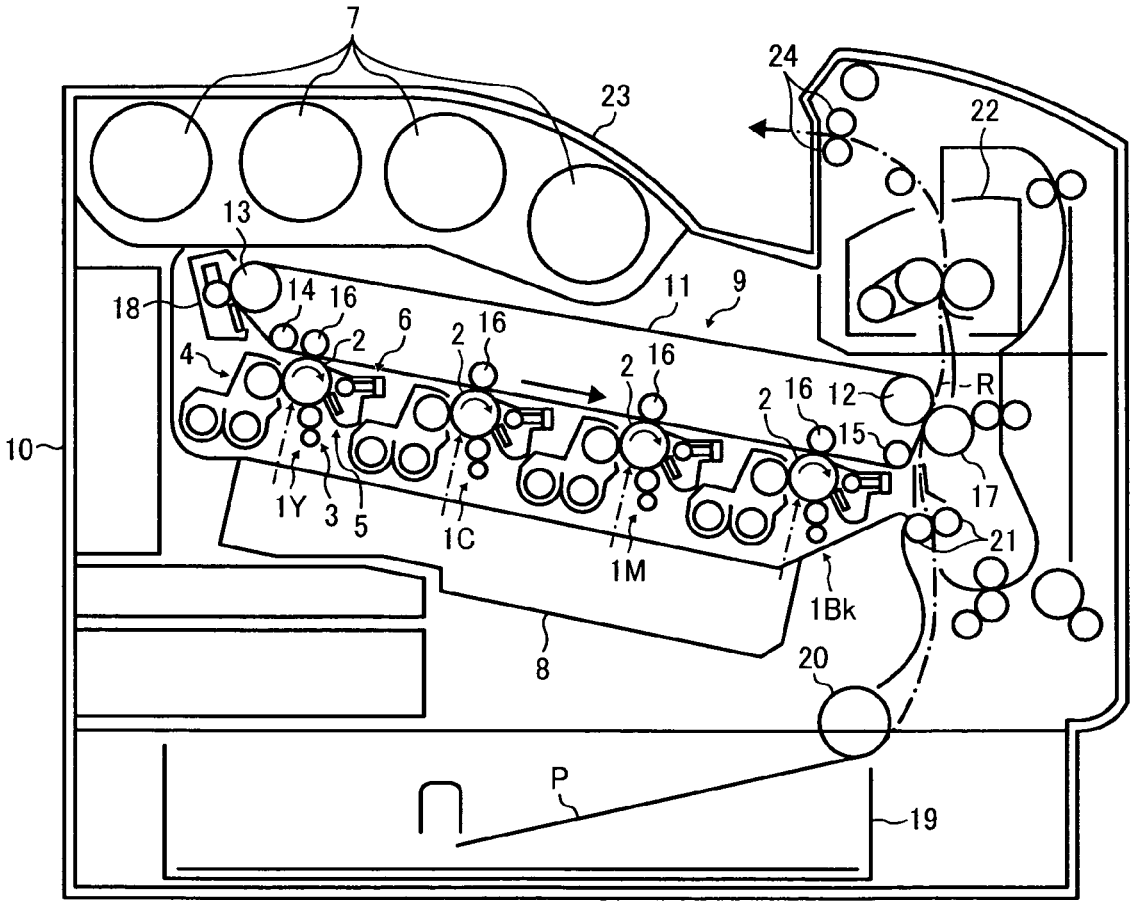
FIG. 1 is a schematic diagram illustrating an image forming apparatus according to an illustrative embodiment of the present invention.

A description is now given of exemplary embodiments of the present invention. It should be noted that although such tetras as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the teems "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating the image forming apparatus according to the illustrative embodiment. The image forming apparatus in FIG. 1 includes a main body 10 and four process units 1Y, 1C, 1M, and 1BK, each of which serves as an image forming unit and is detachably installed in the main body 10. The process units 1Y, 1C, 1M, and 1BK all have the same configuration as all the others, differing only in the color of toner employed. The process units 1Y, 1C, 1M, and 1BK store toners of yellow, cyan, magenta, and black, respectively, corresponding to color separation components of a color image.

More specifically, each of the process units 1Y, 1C, 1M, and 1BK includes, a photoreceptor 2 serving as an image bearing member, a charging device 3, a developing device 4, a cleaning device 5, and a lubricant applicator 6. The charging device 3 charges the surface of the photoreceptor 2. The developing device 4 forms a toner image on the photoreceptor 2. The cleaning device 5 cleans the surface of the photoreceptor 2. The lubricant applicator 6 applies a lubricant on the surface of the photoreceptor 2.

Each of the process units 1Y, 1C, 1M, and 1BK is detachably installed in the image forming apparatus 10.

Toner bottles 7, each of which stores a respective color of toner, are disposed substantially at the upper portion of the main body 10. The toner in the toner bottle 7 is transported to the developing device 4 through a toner transportation tube, not illustrated.

An exposure device 8 is disposed substantially at the bottom of the process units 1Y, 1C, 1M, and 1BK. The exposure device 8 illuminates the surface of each of the photoreceptors 2 with a laser beam projected therefrom.

A transfer device 9 is disposed substantially above the process units 1Y, 1C, 1M, and 1BK. The transfer device 9 includes an intermediate transfer belt 11 consisting of an endless looped belt serving as a transfer member. The intermediate transfer belt 11 is wound around and stretched between a plurality of support rollers 12, 13, 14, and 15. One of the support rollers 12, 13, 14, and 15 is a drive roller, the rotation of which causes the intermediate transfer belt 11 to move in the direction indicated by an arrow in FIG. 1.

Each of four primary transfer rollers 16 serves as a primary transfer mechanism and is disposed facing a respective one of the photoreceptors 2. Each of the primary transfer rollers 16 and the photoreceptors 2 sandwich the intermediate transfer belt 11, thereby defining a primary transfer nip therebetween.

A secondary transfer roller 17 serving as a secondary transfer mechanism is disposed at the right side of the intermediate transfer belt 11 and contacts the intermediate transfer belt 11 from the outside of the loop. The support roller 12 is disposed inside the loop opposite the secondary transfer roller 17, thereby sandwiching the intermediate transfer belt 11 therebetween and defining a secondary transfer nip.

A belt cleaning device 18 is disposed at the left end of the intermediate transfer belt 11 outside the loop.

A sheet feed tray 19, a sheet feed roller 20, and so forth are disposed substantially at the bottom of the main body 10. The sheet feed tray 19 stores a plurality of recording media sheets P. The sheet feed roller 20 transports the recording medium P from the sheet feed tray 19.

Inside the main body 10 of the image forming apparatus, a sheet transport path R that guides the recording medium P from the sheet feed tray 19 is provided. A pair of registration rollers 21 is disposed in the sheet transport path R between the sheet feed roller 20 and the secondary transfer roller 17. The pair of registration rollers 21 sends the recording medium P to the secondary transfer nip in appropriate timing.

A fixing device 22 is disposed substantially above the secondary transfer roller 17. The fixing device 22 fixes an image on the recording medium P. Substantially above the fixing device 22, a sheet stack portion 23 is provided. The upper surface of the main body 10 is bent to form the sheet stack portion 23. The sheet stack portion 23 includes a pair of sheet discharge rollers 24 which discharges the recording medium P onto the sheet stack portion 23.

A description is now provided of a standard operation of the image forming apparatus with reference to FIG. 1.

As the image forming operation is initiated, the photoreceptors 2 of the process units 1Y, 1C, 1M, and 1BK are rotated in a clockwise direction by a driving device, not illustrated, and the surfaces of the photoreceptors 2 are charged uniformly to a predetermined polarity by the charging devices 3.

The charged surface of each of the photoreceptors 2 is illuminated with the laser beam projected from the exposure device 8 based on image information, thereby forming an electrostatic latent image on the surface of each of the photoreceptors 2. The image information exposed on the photoreceptors 2 includes a single-color image information separated into each color, yellow, cyan, magenta, and black.

Subsequently, each of the developing devices 4 supplies a respective color of toner to the electrostatic latent image formed on the photoreceptor 2. The electrostatic latent images are developed as visible images on the photoreceptors 2, also known as toner images.

As the drive roller, around which the intermediate transfer belt 11 is wound, rotates, the intermediate transfer belt 11 moves in the direction indicated by the arrow. Each of the primary transfer rollers 16 is supplied with a constant voltage or a constant current opposite the charge polarity of the toner. Accordingly, a transfer electric field is generated in the primary transfer nip between each of the primary transfer rollers 16 and the photoreceptors 2. The toner images formed on the photoreceptors 2 of the process units 1Y, 1C, 1M, and 1BK are sequentially and overlappingly transferred onto the intermediate transfer belt 11 due to the transfer electric field formed in the primary transfer nips, thereby forming a composite color toner image. The intermediate transfer belt 11 bears the full-color composite toner image on its surface.

After the toner images are transferred from the photoreceptors 2 onto the intermediate transfer belt 11, the lubricant applicator 6 applies the lubricant on the surface of each of the photoreceptors 2. Subsequently, residual toner remaining on each of the photoreceptors 2 is removed by the cleaning device 5.

In the meantime, as the image forming operation is initiated, the sheet feed roller 20 starts to rotate, thereby sending the recording medium P stored in the sheet feed tray 19 to the sheet transport path R. The recording medium P sent to the sheet transport path R is temporarily stopped by the registration rollers 21. The registration rollers 21 starts to rotate again to send the recording medium P to the secondary transfer nip between the secondary transfer roller 17 and the intermediate transfer belt 11 in appropriate timing such that the recording medium P is aligned with the toner image on the intermediate transfer belt 11.

At this time, the secondary transfer roller 17 is applied with the transfer voltage opposite the polarity of the toner image on the intermediate transfer belt 11. Accordingly, the transfer electric field is generated in the secondary transfer nip. As the recording medium and the toner image on the intermediate transfer belt 11 arrive at the secondary transfer nip, the toner image on the intermediate transfer belt 11 is transferred onto the recording medium P due to the transfer electric field generated in the secondary transfer nip.

The residual toner remaining on the intermediate transfer belt 11 after the transfer process is cleaned by the belt cleaning device 18. The recording medium P on which the toner image is transferred is conveyed to the fixing device 22 in which the toner image is fixed on the recording medium P. Subsequently, the recording medium P is discharged onto the sheet stack portion 23 by the sheet discharge roller 24.

The foregoing description pertains to the image forming operation for forming a full-color image on the recording medium. Alternatively, one of the process units 1Y, 1C, 1M, and 1BK may be used to form a single-color image. Still alternatively, two or three process units may be used to form a two-color or a three-color image.

Figure 2:
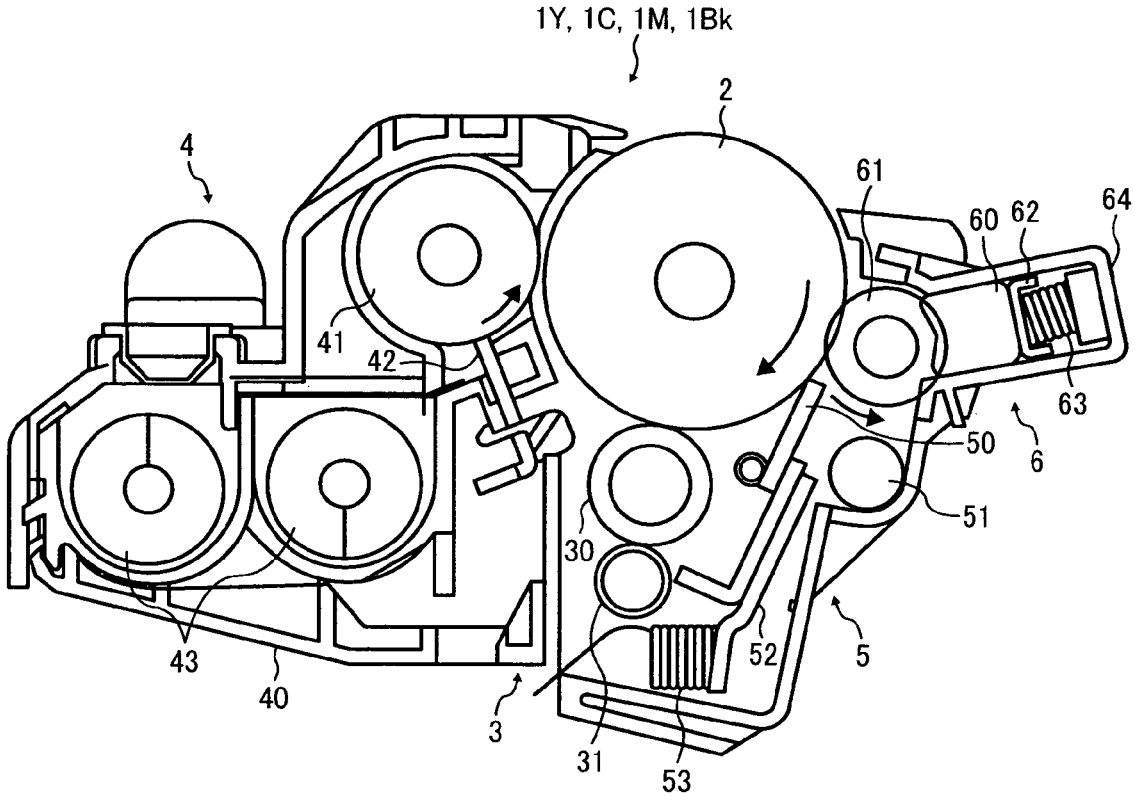
FIG. 2 is a schematic diagram illustrating one of multiple process units employed in the image forming apparatus of FIG. 1.

Referring now to FIG. 2, there is provided a schematic diagram illustrating one of the process units 1Y, 1C, 1M, and 1BK. As described above, the process units 1Y, 1C, 1M, and 1BK all have the same configuration as all the others, differing only in the color of toner employed. Thus, a description is provided of one of the process units.

As illustrated in FIG. 2, the charging device 3 includes a charging roller 30 and a cleaning roller 31. The charging roller 30 is disposed opposite the photoreceptor 2. The cleaning roller 31 is disposed opposite the charging roller 30 on the other side of the photoreceptor 2, and contacts the charging roller 30.

The developing device 4 includes a casing 40, a developing roller 41, a developing blade 42, and conveyance screws 43. The developing roller 41 is rotatably supported by the casing 40 and faces the photoreceptor 2 through an opening provided to the casing 40. The developing blade 42 regulates an amount of developing agent on the developing roller 41. The conveyance screws 43 convey the developing agent in the casing 40. The developing agent herein refers to a two-component developing agent including a toner and a carrier.

The cleaning device 5 includes a cleaning blade 50 and a waste toner recovery coil 51. The cleaning blade 50 removes the residual toner remaining on the photoreceptor 2. The waste toner recovery coil 51 conveys the removed toner to a waste toner bottle, not illustrated. The cleaning blade 50 is held by a holding member 52. When a biasing member 53 presses the holding member 52, the cleaning blade 50 contacts the photoreceptor 2.

The lubricant applicator 6 includes a solid lubricant 60, an application brush 61 serving as a lubricant application member, a lubricant holding member 62, a pressure spring 63, and a guide member 64. The lubricant holding member 62 holds the lubricant 60. The pressure spring 63 urges the lubricant 60 against the application brush 61. The guide member 64 guides the lubricant 60 to contact or separate from the application brush 61.

The application brush 61 is in contact with the surface of the photoreceptor 2 and rotates in a trailing direction relative to the direction of rotation of the photoreceptor 2.

Pressure of the pressure spring 63 causes the lubricant 60 to contact the application brush 61. According to the illustrative embodiment, the pressure spring 63 is employed to press the lubricant 60 to contact the application brush 61. Alternatively, however, a weight may be provided to the lubricant 60 so that the weight causes the lubricant 60 to contact the application brush 61. Still alternatively, the self weight of the lubricant 60 may be configured to cause the lubricant 60 to contact the application brush 61.

The lubricant 60 is fixed to the lubricant holding member 62 by a double-sided tape, an adhesive agent, or the like.

The lubricant 60 is comprised of a metal salt of a fatty acid or a fluorocarbon resin.

The fatty acid may be, for example, a linear hydrocarbon carboxylic acid such as myristic acid, palmitic acid, stearic acid, or oleic acid. The metal may be, for example, lithium, magnesium, calcium, strontium, zinc, cadmium, aluminum, cerium, or titanium. Specific preferred examples of suitable metal salts of fatty acids include, but are not limited to, magnesium stearate, aluminum stearate, iron stearate, and zinc stearate. Among these examples, zinc stearate is most preferable.

With reference to FIG. 2, a description is provided of an operation of the process units 1Y, 1C, 1M, and 1BK.

As the image forming operation is initiated, the photoreceptor 2 is rotated in the clockwise direction while being charged to a certain polarity by the charging roller 30 which is applied with a charging voltage. The charging roller 30 is cleaned by the cleaning roller 31.

Subsequently, the photoreceptor 2 is illuminated with light by the exposure device 8, thereby forming an electrostatic latent image on the surface of the photoreceptor 2. As the photoreceptor 2 rotates, the electrostatic latent image on the photoreceptor 2 comes to a position opposite the developing roller 41 where toner is supplied to the electrostatic latent image.

In particular, after the thickness of the developing agent on the developing roller 41 which rotates in the counterclockwise direction in FIG. 2 is regulated to a certain thickness by the developing blade 42, the developing agent is delivered to a developing region between the developing roller 41 and the photoreceptor 2. In the developing region, the toner in the developing agent moves electrostatically to the electrostatic latent image on the photoreceptor 2, thereby forming the electrostatic latent image into a visible image, also known as a toner image. Subsequently, the toner image on the photoreceptor 2 comes to a position substantially at the top of the photoreceptor 2, and is transferred onto the intermediate transfer belt 11.

After the toner image is transferred, the lubricant is applied to the surface of the photoreceptor 2 by the application brush 61 which rotates in the counterclockwise direction in FIG. 2. After that, the residual toner remaining on the surface of the photoreceptor 2 is removed by the cleaning blade 50. The removed toner is conveyed to the waste toner bottle, not illustrated, by the waste toner recovery coil 51.

Figure 3:
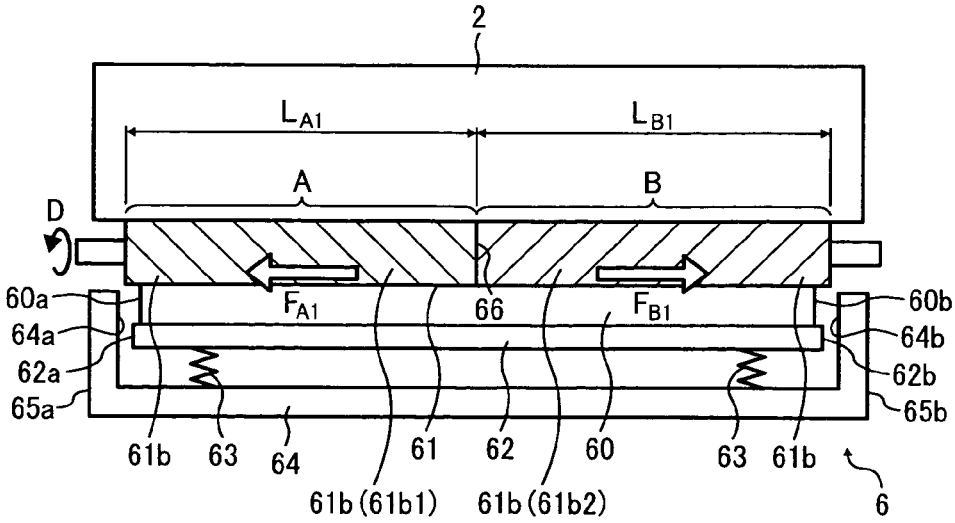
FIG. 3 is a schematic diagram illustrating a lubricant applicator according to an illustrative embodiment of the present invention.

With reference to FIG. 3, a description is now provided of the lubricant applicator 6 according to the illustrative embodiment of the present invention. FIG. 3 is a schematic diagram illustrating the lubricant applicator 6.

As illustrated in FIG. 3, the lubricant 60, the lubricant holding member 62, and the guide member 64 are formed long along the axial direction of the application brush 61. Two pressure springs 63 are each arranged at both ends in the longitudinal direction between the lubricant holding member 62 and the guide member 64.

The guide member 64 has a rectangular box shape including an opening at the application brush side. The lubricant 60 is exposed from the opening of the guide member 64 to contact the application brush 61. The guide member 64 includes side walls 65*a* and 65*b*. Both ends of the application brush 61 in the axial direction are pivotally supported at the side walls 65*a* and 65*b* through shaft bearings 56*a* and 56*b* (see FIG. 7).

In order to allow the lubricant 60 to contact or separate from the application brush 61 in the guide member 64, a certain space is provided between an end portion 60*a* (60*b*) of the lubricant 60 in the longitudinal direction and a guide surface 64*a* (64*b*) facing the end portion 60*a* (60*b*).

For the similar reason, a certain space is provided between an end portion 62*a* (62*b*) of the lubricant holding member 62 in the longitudinal direction and the guide surface 64*a* (64*b*) facing the end portion 62*a* (62*b*).

Figure 4:
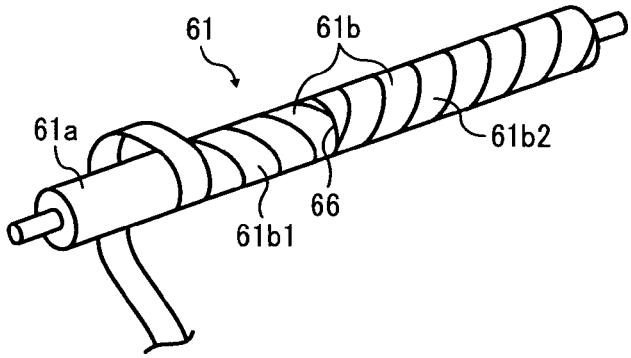
FIG. 4 is a schematic perspective view of an application brush employed in the lubricant applicator of FIG. 3 during manufacture according to an illustrative embodiment of the present invention.

With reference to FIG. 4, a description is now provided of the application brush 61 according to the illustrative embodiment of the present invention. FIG. 4 is a schematic perspective view of the application brush 61 during manufacture.

As illustrated in FIG. 4, the lubricant application brush 61 is formed of a core member 61*a* and a bristle member 61*b*. The core member 61*a* is a metal rod or a metal hollow cylinder. The bristle member 61*b* is a strip member on which fibers are implanted, and wound spirally on the outer circumference of the core member 61*a*.

The bristle member 61*b* is formed of a lace ground cloth on which pile fibers that are durable are implanted. The bristle member 61*b* is adhered to the outer circumference of the core member 61*a* using an adhesive agent, a both-sided tape, or the like.

According to the illustrative embodiment, as illustrated in FIG. 3, the direction of winding of the bristle member 61*b* changes from the center of the application brush 61 in the axial direction (in a longitudinal direction) of the core member 61*a*. In FIG. 3, reference character "A" refers to a first wound portion which is a portion of the application brush 61 between the center and the left end portion of the application brush 61 in the axial direction on which the bristle member 61*b* (61*b*1) is wound. Reference character "B" refers to a second wound portion which is a portion of the application brush 61 between the center and the right end portion of the application brush 61 in the axial direction on which the bristle member 61*b* (61*b*2) is wound in the opposite direction from the first wound portion A in the axial direction.

It is to be noted that the bristle member 61*b*1 in the first wound portion A and the bristle member 61*b*2 in the second wound portion B have the same structure. Furthermore, a length $L_{A1}$ of the first wound portion A and a length $L_{B1}$ of the second wound portion A are the same.

With reference to FIG. 3, a description is provided of an effect of the illustrative embodiment. As illustrated in FIG. 3, in the lubricant applicator 6, as the application brush 61 is rotated, the moving forces $F_{A1}$ and $F_{B1}$ that cause the lubricant 60 to move axially are generated in the first wound portion A and the second wound portion B, respectively. However, because the bristle member 61*b* (61*b*1) of the first wound portion A is wound in a direction opposite the direction of the winding of the bristle member 61*b* (61*b*2) of the second wound portion B in the axial direction, the moving forces $F_{A1}$ and $F_{B1}$ act in opposite directions. As a result, the moving force $F_{A1}$ in the first wound portion A and the moving force $F_{B1}$ generated in the second wound portion B cancel one another.

Furthermore, according to the illustrative embodiment, since the length $L_{A1}$, of the first wound portion A and the length $L_{B1}$ of the second wound portion B are the same, the size of the moving force $F_{A1}$ generated in the first wound portion A and the size of the moving force $F_{B1}$ generated in the second wound portion B correspond each other, thereby completely cancelling the moving force $F_{A1}$ and the moving force $F_{B1}$.

As a result, the lubricant 60 is prevented from moving axially of the application brush 61, and a portion of the lubricant 60 or a portion of the lubricant holding member 62 is prevented from contacting undesirably the guide member 64.

Figure 5:
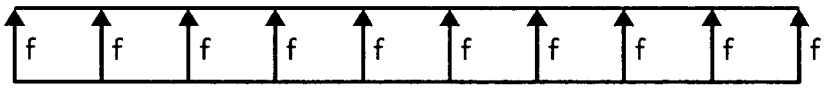
FIG. 5 is a schematic diagram illustrating a force acting on to the application brush.

Referring now to FIG. 5, there is provided a schematic diagram illustrating a direction of force acting on the application brush 61 at the contact portion of the lubricant 60 with the application brush 61. As can be understood from FIG. 5, a force f is applied against the application brush 61 evenly in the axial direction thereof, thereby applying evenly the lubricant 60 to the photoreceptor 2.

With this configuration, a portion of the lubricant 60 or the lubricant holding member 62 in the longitudinal direction is prevented from contacting the guide member 64. Accordingly, the pressure of the lubricant 60 at both ends thereof in its longitudinal direction against the application brush 61 is prevented from varying, thereby enabling the application brush 61 to apply the lubricant evenly on the photoreceptor 2 in the axial direction. Because the lubricant 60 is pressed against the application brush 61 evenly in the longitudinal direction, irregular abrasion of the lubricant 60 is prevented. The lubricant 60 is consumed effectively. In a case in which the length $L_{A1}$ of the first wound portion A is different from the length $L_{B1}$ of the second wound portion B, either the moving force $F_{A1}$ or the moving force $F_{B1}$ is greater than the other. In this configuration, the moving forces $F_{A1}$ and $F_{B1}$ do not completely cancel one another, but the remaining moving force is substantially small. Therefore, even when the remaining moving force causes the lubricant 60 to move axially causing the portion of the lubricant 60 or the lubricant holding member 62 to contact the guide member, the resistance caused in the contact area is insignificant, thus reducing the difference in the pressure of the lubricant 60 at both ends thereof in the longitudinal direction relative to the application brush 61.

With this configuration, the lubricant 60 can be applied evenly by the application brush 61, thus preventing irregular abrasion thereof. As long as the moving force in the axial direction relative to the lubricant 60 is reduced, if not cancelled completely, the retaining force of the pressure spring 63 may still prevent the lubricant 60 from moving in the axial direction.

Figure 6:
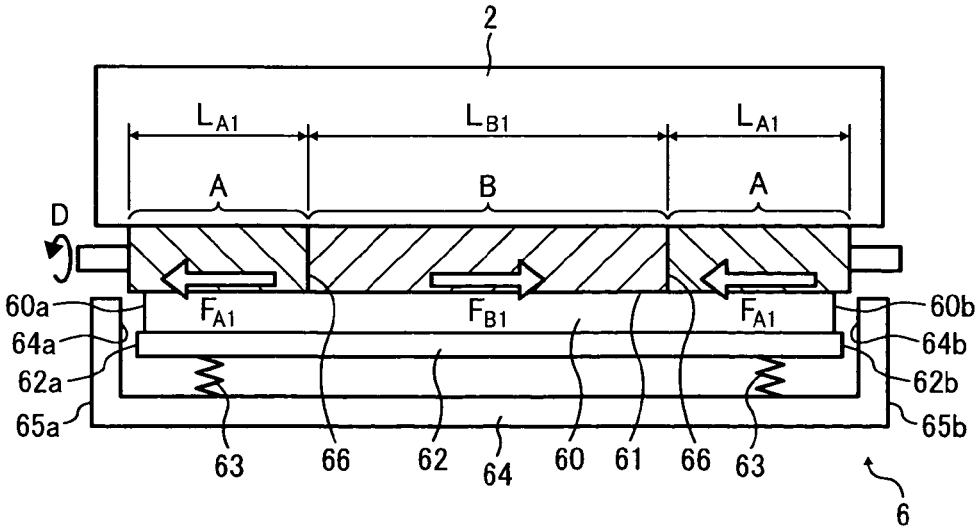
FIG. 6 is a schematic diagram illustrating a lubricant applicator according to another illustrative embodiment.

With reference to FIG. 6, a description is provided of the lubricant applicator 6 according to another illustrative embodiment. FIG. 6 is a schematic diagram illustrating the lubricant applicator 6 according to another illustrative embodiment.

As illustrated in FIG. 6, the application brush 61 includes alternating bands of the first wound portion A and the second wound portion B, and the sum of the lengths of the bands of the first wound portion equals the sum of the lengths of the bands of the second wound portion.

In particular, according to the present embodiment, the first wound portion A, the second wound portion B, and the first wound portion A are provided axially, in that order, from the left end portion of the application brush 61 to the right end portion thereof as illustrated in FIG. 6. Alternatively, however, the positions of the first wound portion A and the second wound portion B may be switched.

Moreover, the sum of the lengths of the bands of the first wound portion A (here, the sum of two first wound portions A in the axial direction) equals the sum of the length of the band of the second wound portion B (here, there is only one second wound portion B). It is to be noted, however, that a configuration other than what is described above is similar or identical to that shown in FIGS. 3 and 4, and thus a description thereof is omitted. With reference to FIG. 6, a description is provided of an effect of the present embodiment described in FIG. 6.

As illustrated in FIG. 6, as the application brush 61 of the lubricant applicator 6 is rotated, the moving force $F_{A1}$ is generated in each of two first wound portions A in the direction opposite the direction of the moving force $F_{g1}$ generated in the second wound portion B in the axial direction. Since the moving forces $F_{A1}$ act in the direction opposite the moving force $F_{B1}$, the moving forces $F_{A1}$ and $F_{B1}$ are cancelled out.

According to the illustrative embodiment shown in FIG. 6, the sum of the lengths $L_{A1}$ of two first wound portions A corresponds to the length $L_{B1}$ of the second wound portion B so that the sum of the moving forces $F_{A1}$ generated in two first wound portions A also corresponds to the moving force $F_{B1}$ of the second wound portion B. As a result, the moving forces $F_{A1}$ and the moving force $F_{B1}$ are cancelled out completely.

Similar to the illustrative embodiment described in FIG. 3, this configuration also prevents the lubricant 60 from moving axially, thereby allowing uniform application of the lubricant 60 axially by the application brush 61 while preventing irregular abrasion of the lubricant 60.

Furthermore, even when the sum of the lengths $L_{A1}$ of two first wound portions A in the axial direction does not coincide with the length $L_{B1}$ of the second wound portion B, the moving force in the axial direction can be reduced, similar to the illustrative embodiment shown in FIG. 3. Accordingly, the amount of application of the lubricant 61 is prevented from varying, and irregular abrasion of the lubricant 60 is suppressed, if not prevented entirely.

According to the illustrative embodiments described above, the lubricant can be applied evenly or irregular abrasion of the lubricant is suppressed with a simple configuration in which the bristle members are wound in different directions on the application brush. With this configuration, the number of parts is reduced, thus achieving reduction in man-hour and manufacturing cost.

Figure 13:
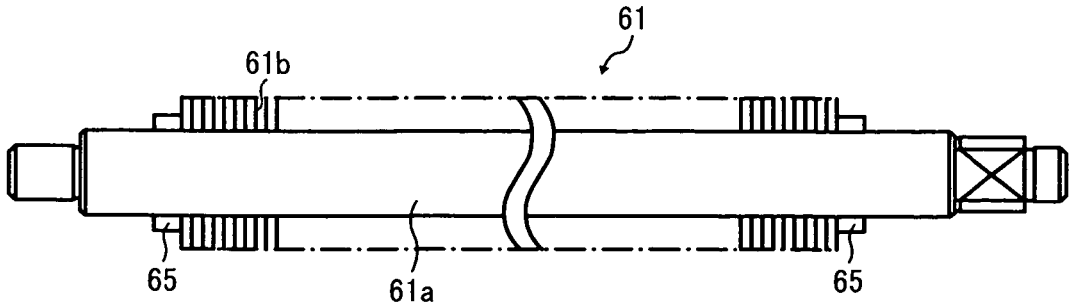
FIG. 13 is a schematic diagram illustrating both ends of the application brush subjected to a peel prevention process.
Figure 14:
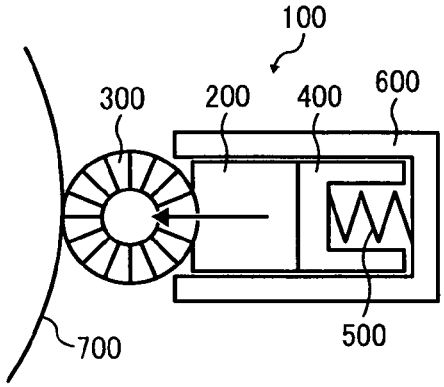
FIG. 14 RELATED ART
FIG. 14 is a schematic diagram illustrating a related-art lubricant applicator.
Figure 15:
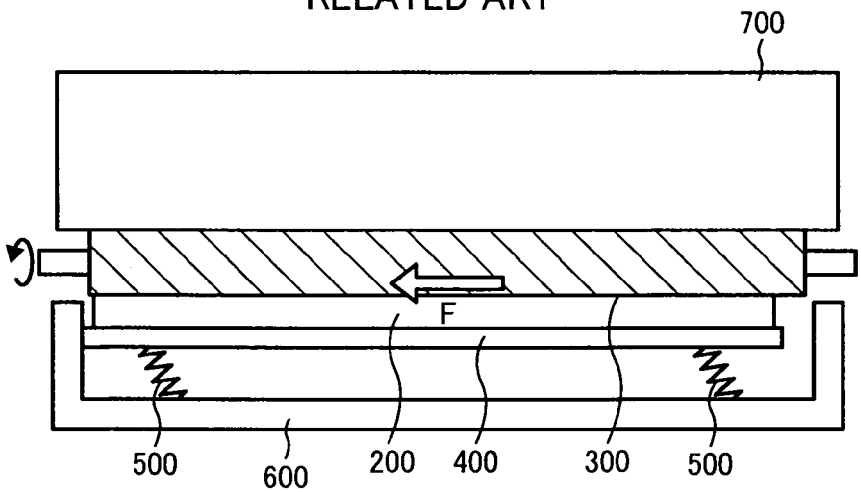
FIG. 15 RELATED ART
FIG. 15 is a schematic diagram illustrating a lubricant contacting a guide member.
Figure 16:
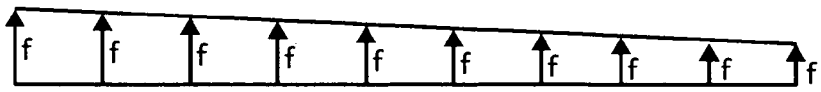
FIG. 16 is a schematic diagram illustrating a force acting on a related-art application brush.
Figure 17:
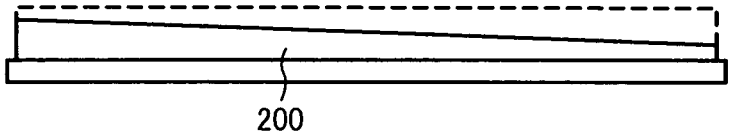
FIG. 17 RELATED ART
FIG. 17 is a schematic diagram illustrating the lubricant irregularly abraded.
Figure 18:
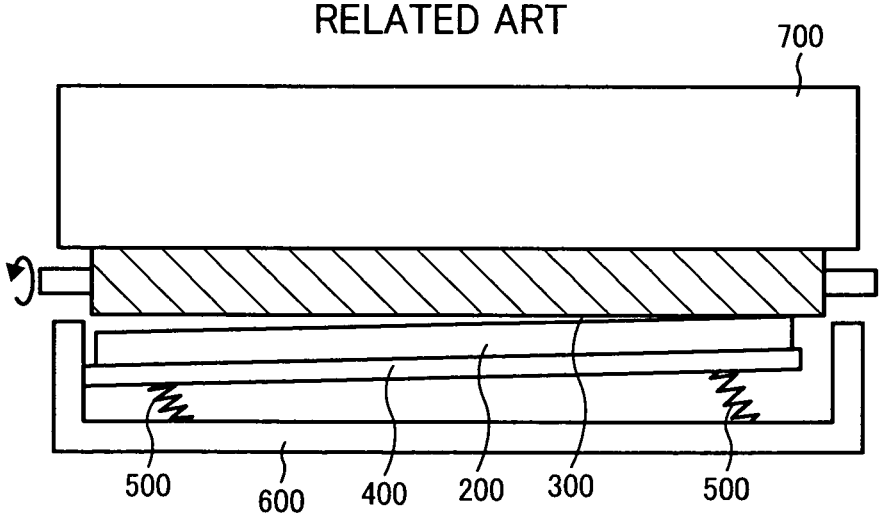
FIG. 18 RELATED ART
FIG. 18 is a schematic diagram illustrating the lubricant tilted relative to an application brush.
Figure 19A:
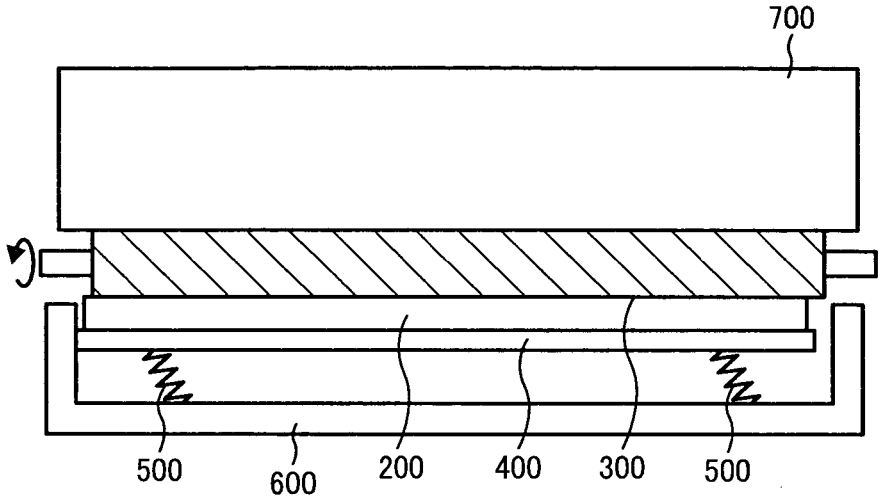
FIG. 19A RELATED ART
FIG. 19A is a schematic diagram illustrating one end portion of the lubricant offset from the application brush.
Figure 19B:
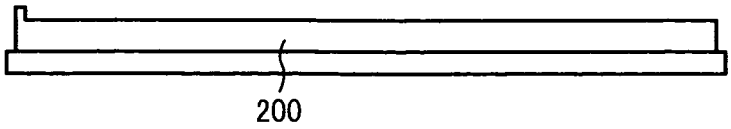
FIG. 19B RELATED ART
FIG. 19B is a schematic diagram illustrating the lubricant irregularly abraded.

However, in a configuration in which the application brush 61 includes the core member 61*a* and the bristle member 61*b* wound spirally around the peripheral surface of the core member 61*a*, the bristle member 61*b* at the end portions in the axial direction may be peeled off. In view of the above, as illustrated in FIG. 13, a peel prevention strip 65 is provided at both end portions of the bristle member 61*b*. The peel prevention strip 65 includes emulsion adhesion, ultrasonic welding, or the like. The emulsion adhesion uses an emulsion adhesion agent to adhere the end portions of the bristle member 61*b*. The ultrasonic welding includes melting thermoplastic resin with fine ultrasonic vibration and pressure.

For the emulsion adhesion, the width is approximately 2.5 mm or less. For the ultrasonic welding, the width is approximately 3.5 mm or less.

The peel prevention strip 65 reduces, if not prevents entirely, peeling of the bristle member 61*b* at the end portions in the axial direction in the illustrative embodiments described in FIG. 3, FIG. 6, and so forth.

Although advantageous, providing the peel prevention strip 65 at both ends of the bristle member 61*b* may cause a seam portion 66 (shown in FIG. 4) between the bristle member 61*b*1 of the first wound portion A and the bristle member 61*b*2 of the second wound portion B to separate, forming a gap of approximately 2.5 mm for the emulsion adhesion and the ultrasonic welding in a circumferential direction of the brush 61. If such a gap is formed in the circumferential direction, the lubricant 60 is not scraped in the gap so that the portion of the photoreceptor 2 or the like that faces the gap is not supplied with the lubricant 60.

On the other hand, if the bristle member 61*b*1 and the bristle member 61*b*2 are overlapped undesirably, the overlapping portion of the bristle member scrapes the lubricant 60 more than other portions, thereby varying the amount of the lubricant 60 applied to the photoreceptor 2.

Figure 7:
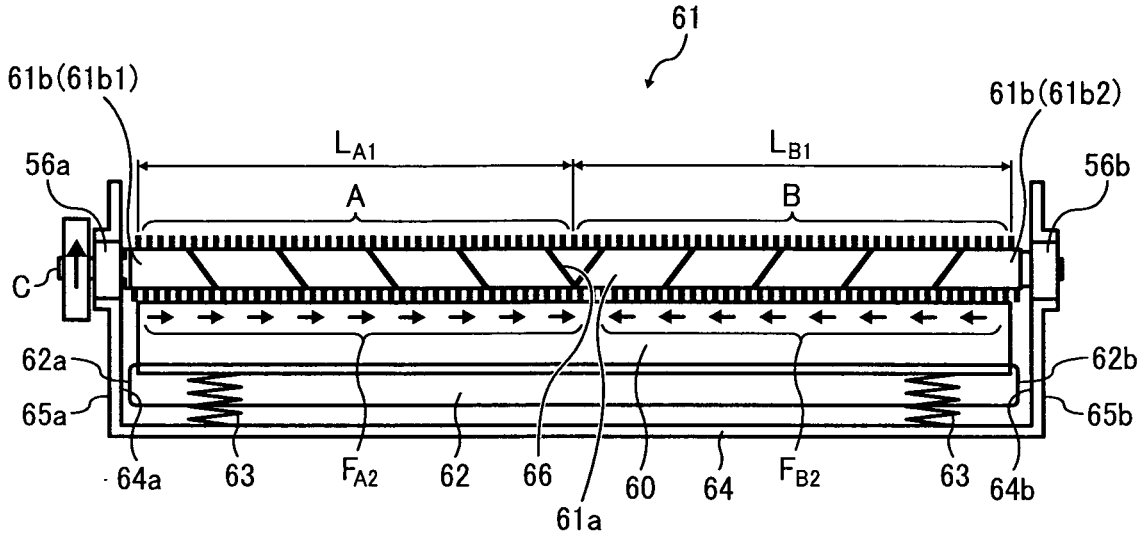
FIG. 7 is a schematic diagram illustrating a lubricant applicator according to still another illustrative embodiment.
Figure 8:
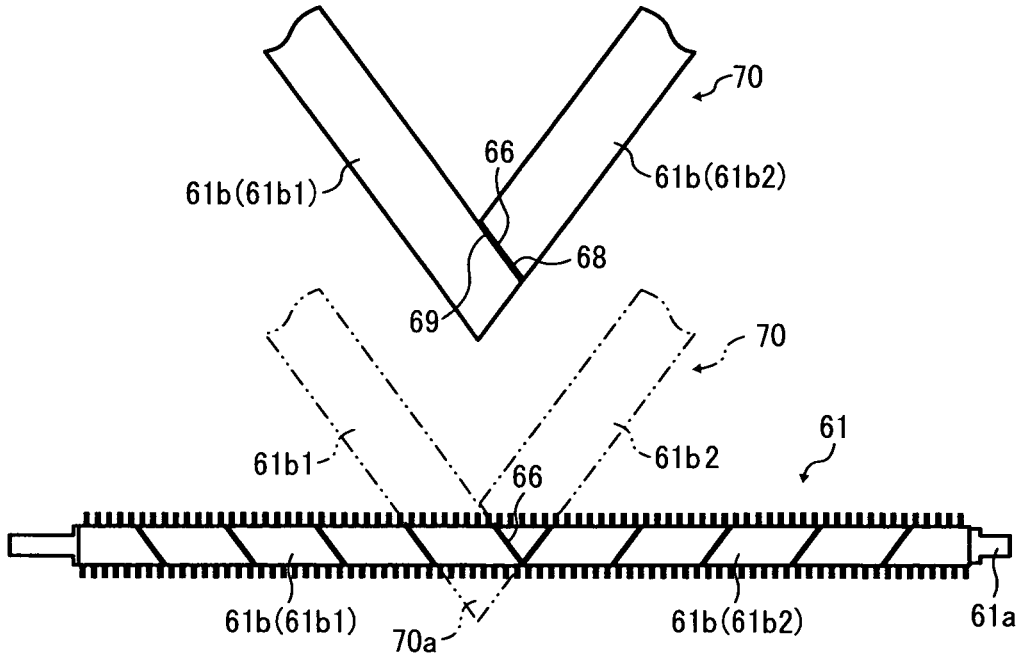
FIG. 8 is a schematic diagram illustrating a method of winding a bristle member employed in the lubricant applicator of FIG. 7.

In view of the above, as illustrated in FIGS. 7 and 8, the bristle member 61*b*1 of the first wound portion A and the bristle member 61*b*2 of the second wound portion B are spirally wound around the core member 61*a* such that the seam portion 66 wound spirally around the core member 61*a* is offset or oblique relative to the circumferential direction perpendicular to the axis of the core member 61.

In particular, as illustrated in FIG. 8, the bristle member 61*b*1 and the bristle member 61*b*2 are connected to each other to form a substantially V-shaped intersection. In other words, an end portion 69 of the bristle member 61*b*2 of the second wound portion B in the axial direction abuts an end portion 68 on one side of the bristle member 61*b*1 of the first wound portion A. In this configuration, prior to winding spirally the bristle members 61*b*1 and 61*b*2 around the core member 61*a*, a band 70 consisting of the bristle members 61*b*1 and 61*b*2 is formed.

As illustrated in FIG. 8, a broken line indicates a virtual line representing the band 70. As illustrated in FIG. 8, a base portion 70*a* of the band 70 is positioned substantially at the center of the core member 61*a* in the axial direction, and the bristle member 61*b*1 and the bristle member 61*b*2 are wound around the core member 61*a*. Accordingly, the first wound portion A comes to the left side in FIG. 8, and the second wound portion B comes to the right side in FIG. 8. The length $L_{A1}$ of the first wound portion A and the length $L_{B1}$ of the second wound portion B are the same (see FIG. 7).

In this configuration, as illustrated in FIG. 7, as the application brush 61 rotates in the direction indicated by an arrow C, a force in a direction of $F_{A2}$ acts on the lubricant 60 contacting the application brush 61 of the first wound portion A, and a force in a direction of $F_{B2}$ acts on the lubricant 60 contacting the application brush 61 of the second wound portion B. Similar to the application brush 61 as described in FIG. 3, the size of the moving force $F_{A2}$ generated in the first wound portion A equals the size of the moving force $F_{B2}$ generated in the second wound portion B, thereby cancelling out both forces completely. Accordingly, the application brush 61 is prevented from shifting axially, thereby maintaining a space between the end portions 62*a* and 62*b* of the lubricant holding member 62 and the guide surfaces 64*a* and 64*b*.

With the configuration described above, because the seam portion 66 of the bristle member 61*b*1 and the bristle member 61*b*2 do not coincide in the circumferential direction, an undesirable gap is prevented from arising, thereby applying the lubricant 60 evenly. Furthermore, the bristle members 61*b*1 and 61*b*2 are prevented from peeling off.

Figure 9:
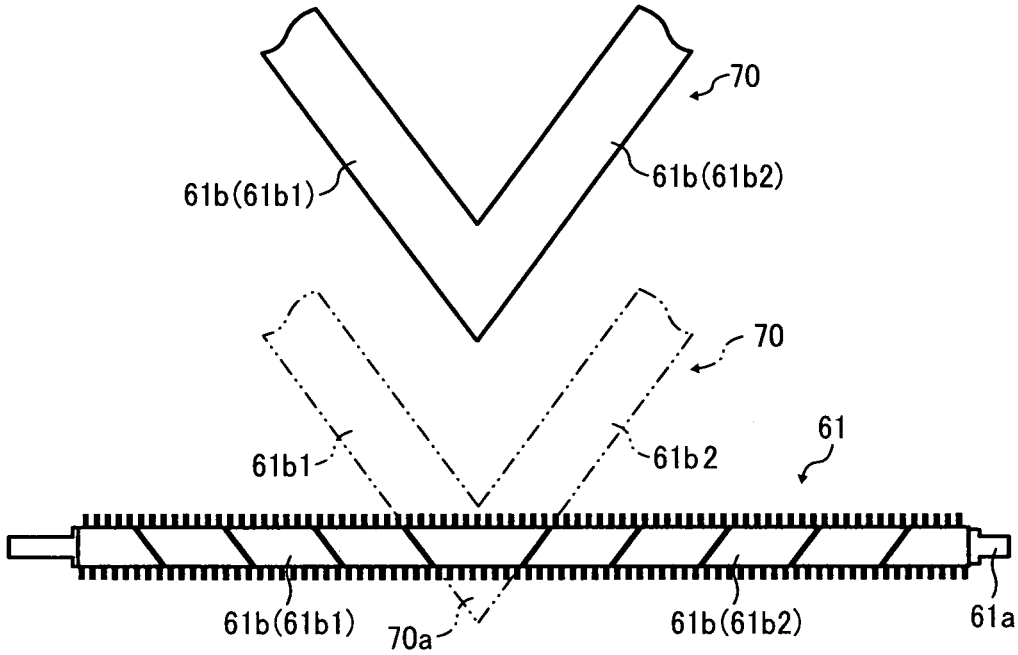
FIG. 9 is a schematic diagram illustrating another method of winding the bristle member of the lubricant applicator of FIG. 7.

Alternatively, as illustrated in FIG. 9, the bristle member 61*b*1 and the bristle member 61*b*2 may be formed as a single integrated V-shaped member constituting the band 70. In other words, there is no seam portion 66 between the bristle member 61*b*1 of the first wound portion A and the bristle member 61*b*2 of the second wound portion B.

Similar to FIG. 8, in FIG. 9, a broken line indicates a virtual line representing the band 70. As illustrated in FIG. 9, the base portion 70*a* of the band 70 is positioned substantially at the center of the core member 61*a* in the axial direction, and the bristle member 61*b*1 and the bristle member 61*b*2 are wound around the core member 61*a*. Accordingly, the first wound portion A comes to the left side in FIG. 9, and the second wound portion B comes to the right side in FIG. 9.

In this configuration as illustrated in FIG. 9, a similar if not the same effect as that of the application brush 61 described in FIG. 8 is achieved. In particular, since there is no seam portion, no gap is formed and the lubricant 60 is applied reliably and seamlessly. Furthermore, the bristle member 61*b*1 and the bristle member 61*b*2 are prevented from peeling off.

Figure 10:
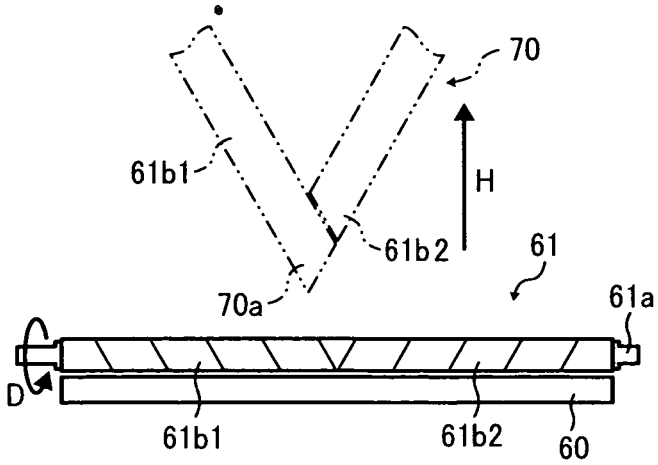
FIG. 10 is a schematic diagram illustrating a winding direction of the bristle member and a direction of rotation of the application brush.

Referring now to FIG. 10, there is provided a schematic diagram illustrating the winding direction of the bristle member 61*b* and the direction of rotation of the application brush 61.

As illustrated in FIG. 10, if the band 70 is positioned as illustrated by the virtual line relative to the core member 61*a* and the application brush 61 is rotated in the direction of arrow D, the application brush 61 rotates in the direction opposite the winding direction of the bristle members 61*b*1 and 61*b*2.

Figure 11:
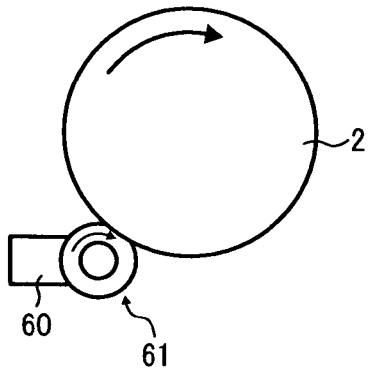
FIG. 11 is a schematic diagram illustrating the direction of rotation of the application brush and a photoreceptor.
Figure 12:
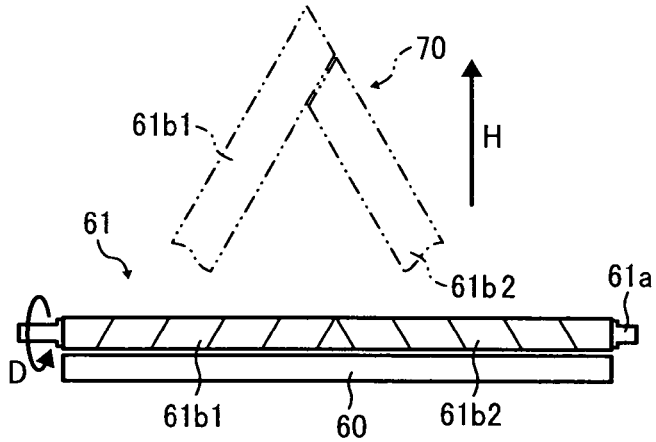
FIG. 12 is a schematic diagram illustrating the winding direction of the bristle member and the direction of rotation of the application brush.

By contrast, as illustrated in FIG. 12, if the band 70 is positioned as illustrated by the virtual line relative to the core member 61*a* and the application brush 61 is rotated in the direction of arrow D, the application brush 61 rotates in the same direction as the winding direction of the bristle members 61*b*1 and 61*b*2. If the photoreceptor 2 and the application brush 61 rotate in the direction of arrows as illustrated in FIG. 11 (the application brush 61 rotates in the direction D as illustrated in FIGS. 10 and 12), a frictional force acts on the application brush 61 in the direction of arrow H from the lubricant 60, the photoreceptor 2, and so forth. As a result, when the bristle members 61*b*1 and 61*b*2 are wound in the direction as illustrated in FIG. 10 (the direction of rotation of the application brush 61 is opposite the direction of winding of the bristle members 61*b*1 and 61*b*2), a force that causes the base portion 70*a* of the band 70 to be peeled off acts on the base portion 70*a*. Therefore, the base portion 70*a* of the band 70 needs to be adhered securely to the core member 61*a*.

To address such a difficulty, as illustrated in FIG. 12, the direction of rotation of the application brush 61 is configured to be the same as the direction of winding of the bristle members 61*b*1 and 61*b*2. In this configuration, the photoreceptor 2 and the application brush 61 rotate in the direction indicated by an arrow in FIG. 12. A force that prevents the base portion 70*a* of the band 70 from getting peeled acts on the base portion 70*a* so that the base portion 70*a* does not need to be adhered securely, thus improving reliability and reducing cost.

It is to be understood that the present invention is not limited to the embodiments described above. It is to be understood that elements and/or features of different illustrative embodiments may be combined with each other and/or substituted for each other within the scope of this disclosure and appended claims.

For example, according to one illustrative embodiment described above, the lubricant application member includes alternating bands of the first wound portion and the second wound portion in the axial direction, and the sum of the lengths of the bands of the first wound portion A equals the sum of the lengths of the bands of the second wound portion B. The bands of the first wound portion A and the second wound portion B wound in the direction different from the first wound portion A are alternately provided in the axial direction. In particular, according to the illustrative embodiment, the total of three alternating bands of the first wound portion and the second wound portion are provided. Alternatively, more than three alternating bands of the first wound portion and the second wound portion may be provided in the axial direction.

In such a case, it is preferable that the sum of the lengths $L_{A1}$ of the bands of the first wound portion A equals the sum of the lengths $L_{B1}$ of the bands of the second wound portion B in the axial direction in order to cancel out the moving forces generated in the first wound portion A and the second wound portion B.

A winding angle of the first wound portion A and the second wound portion B is not limited to a single winding angle, and although it is preferable that the winding angle of the first wound portion A and the winding angle of the second wound portion B are the same, the winding angle may be changed as long as the bristle member 61 is wound around the core member 61*a*. Alternatively, however, the winding angle of the first wound portion A and the winding angle of the second wound portion B may be different.

According to the illustrative embodiments, the present invention is employed in the lubricant applicator to apply the lubricant on the photoreceptor. The present invention is not limited to this. The present invention can be applied to the device that applies the lubricant to the transfer member such as the intermediate transfer belt or the like. Furthermore, the present invention can be applied to a device that applies to a lubricant on a target other than the photoreceptor or the transfer member.

According to the illustrative embodiment, the present invention is employed in the image forming apparatus using a lubricant applicator. The image forming apparatus includes, but is not limited to, a color image forming apparatus illustrated in FIG. 1, a monochrome image forming apparatus, a copier, a printer, a facsimile machine, and a multi-functional system.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A lubricant applicator, comprising:

a lubricant; and a rotatable lubricant application member configured to contact the lubricant and an application target to apply the lubricant to the application target while rotating, the rotatable lubricant application member including a core member, a first wound portion including a bristle member wound spirally around a periphery of the core member in a first direction, and a second wound portion including a bristle member wound spirally around the periphery of the core member in a second direction opposite the first direction in an axial direction of the core member, one end of the first wound portion abutting against one end of the second wound portion at a center of the core member such that the abutting provides a seamless transition from the first wound portion to the second wound portion.

2. The lubricant applicator according to claim 1, further comprising:

a guide member disposed opposite an end portion of the lubricant corresponding to an end portion of the lubricant application member in an axial direction thereof, and configured to guide the lubricant to contact and separate from the lubricant application member, wherein the lubricant is biased against the lubricant application member using at least one of a biasing member or a weight of the lubricant.

3. The lubricant applicator according to claim 1, wherein the first wound portion and the second wound portion are each disposed in the axial direction and have identical lengths.

4. The lubricant applicator according to claim 1, wherein the lubricant application member includes alternating bands of the first wound portion and the second wound portion, wherein a sum of lengths of the bands of the first wound portion equals a sum of lengths of the bands of the second wound portion.

5. The lubricant applicator according to claim 4, wherein the band of the second wound portion is located in between a first band of the first wound portion and a second band of the first wound portion.

6. The lubricant applicator according to claim 5, wherein a moving force generated in the second wound portion equals a sum of moving forces generated in the first band and the second band of the first wound portion.

7. The lubricant applicator according to claim 1, wherein the lubricant comprises zinc stearate.

8. The lubricant applicator according to claim 1, wherein the bristle member of the first wound portion and the bristle member of the second wound portion are wound spirally around the core member, and a seam portion at a point of abutting between the first wound portion and the second wound portion is oblique relative to a circumferential direction of the core member.

9. A process unit detachably attachable to an image forming apparatus, comprising:

an image bearing member configured to bear an image; and the lubricant applicator of claim 1.

10. An image forming apparatus, comprising the process unit of claim 9.

11. A transfer device, comprising:

a transfer member onto which an image on an image bearing member is transferred; and the lubricant applicator of claim 1.

12. An image forming apparatus, comprising the transfer device of claim 11.

13. An image forming apparatus, comprising:

a removable process unit configured to be installed in the image forming apparatus and having an image bearing member to bear an image;

a transfer member onto which the image on the image bearing member is transferred; and the lubricant applicator of claim 1.

14. An image forming apparatus, comprising the lubricant applicator of claim 1.

15. The lubricant applicator according to claim 1, wherein a moving force generated in the first wound portion cancels a moving force generated in the second wound portion.

* * * * *